United States Patent [19]

Sceberras

[11] Patent Number: 4,501,066

[45] Date of Patent: Feb. 26, 1985

[54] DUAL HEADED RAZOR SYSTEM

[76] Inventor: Conrad T. Sceberras, 3101 S. Capa Dr., Hacienda Heights, Calif. 91745

[21] Appl. No.: 483,657

[22] Filed: Apr. 11, 1983

[51] Int. Cl.[3] ..... B26B 21/14; B26B 21/00; B26B 21/08

[52] U.S. Cl. ..... 30/50; 30/47; 30/48

[58] Field of Search ..... 30/47, 48, 50, 75, 85

[56] References Cited

U.S. PATENT DOCUMENTS

| | | | |
|---|---|---|---|
| 1,589,826 | 6/1926 | Strand | 30/48 |
| 2,517,028 | 8/1950 | Ridner, Sr. | 30/50 |
| 2,587,964 | 3/1952 | Burns | 30/50 |
| 3,724,070 | 4/1973 | Durion, Jr. | 30/47 |
| 3,748,734 | 7/1973 | Holohan | 30/85 |
| 4,285,124 | 8/1981 | Diakonov | 30/50 |

FOREIGN PATENT DOCUMENTS

| | | | |
|---|---|---|---|
| 206980 | 2/1908 | Fed. Rep. of Germany | 30/50 |
| 52-15761 | 2/1977 | Japan | 30/50 |
| 365149 | 7/1931 | United Kingdom | 30/50 |

*Primary Examiner*—Paul A. Bell
*Assistant Examiner*—Paul M. Heyrana, Sr.
*Attorney, Agent, or Firm*—Sellers and Brace

[57] ABSTRACT

Disclosed is a dual headed razor system having a handle supporting a pair of separately detachable razor heads respectively useful in shaving forwardly and rearwardly in to and fro strokes. The identical razor heads are usable interchangeably and are telescopically supported crosswise of the handle.

5 Claims, 3 Drawing Figures

DUAL HEADED RAZOR SYSTEM

This invention relates to razor systems and more particularly to an improved dual headed razor system supporting a plurality of cutting blades disposed for shaving as the razor is moved forwardly and rearwardly.

BACKGROUND OF THE INVENTION

For many decades razor designers have made efforts to provide a razor system having more than one blade so disposed relative to one another as to permit shaving while moving the razor forwardly and rearwardly. Examples of such efforts are disclosed in U.S. Pat. to Muros No. 1,890,334; Welch No. 3,488,764; Edson No. 3,593,416; Perry No. 3,768,162; Nissen No. 3,871,073 and the Italian Pat. No. 308,419 granted June 3rd, 1933. Each of these systems is subject to certain shortcomings and disadvantages and more particularly to the lack of adequate provision for safeguarding against injuries and mishaps. Additionally the cutting edges of the blades face toward one another and are closely spaced apart.

SUMMARY OF THE INVENTION

The disadvantages and shortcomings of prior razor systems designed for to and fro shaving are avoided by this invention. Typically, the operating handle is provided with a pair of mounting channels for similar or identical razor heads. These channels are located in a common plane at an obtuse angle to the handgrip or handle. Each channel telescopically seats a respective razor head each having either a single or a pair of cutting blades. The two razor heads are mounted with their adjacent lateral edges in close proximity to one another and with the cutting edges of their respective blades facing away from one another and lying closely spaced inwardly from glide and protective surfaces crosswise of the opposite ends of the blades and along a respective one of the cutting blade edges. As herein shown by way of example, each head is of a well known conventional construction employing a pair of blades having their cutting edges arranged in echelon and spaced inwardly from the guard member therefor.

Accordingly, it is a primary object of the invention to provide a new and unique dual headed razor system equally effective and efficient in both forward and rearward strokes.

Another object of the invention is the provision of an improved razor system utilizing a pair of disposable razor heads separated and supported in close proximity and appropriately disposed for to and fro shaving.

Another object of the invention is the provision of a superior razor system for expediting and facilitating a shaving operation.

These and other more specific objects will appear upon reading the following specification and claims and upon considering in connection therewith the attached drawing to which they relate.

Referring now to the drawing in which a preferred embodiment of the invention is illustrated:

Figure 1:
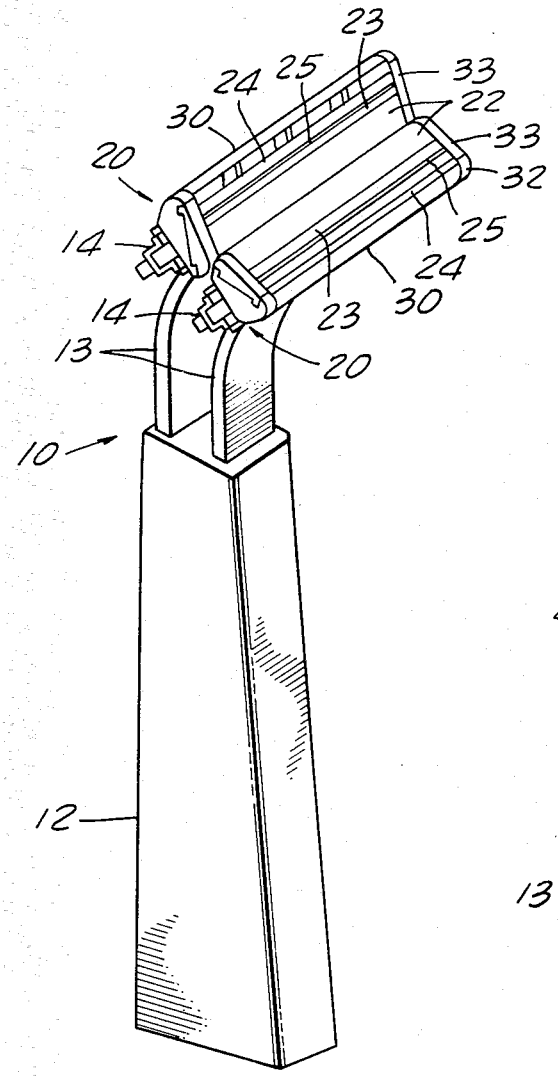
FIG. 1 is a perspective view of an illustrative embodiment of my to and fro razor system.
Figure 2:
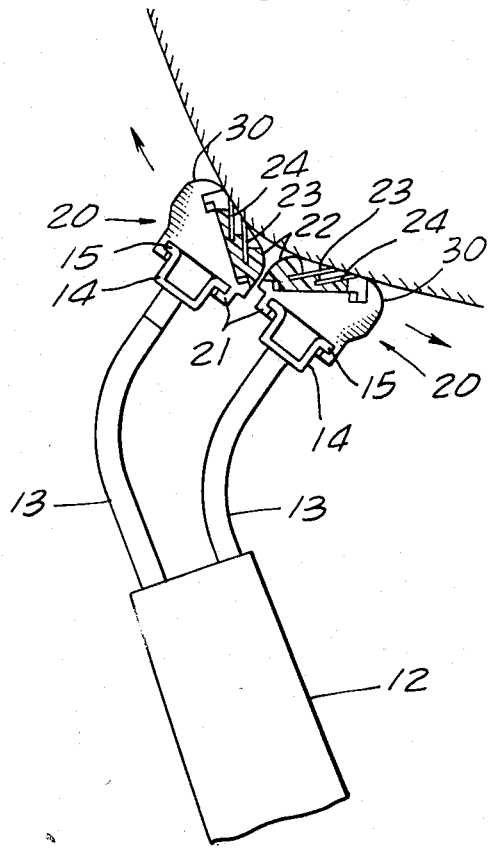
FIG. 2 is a fragmentary end elevational view partly in cross section showing the razor in use.

Referring initially more particularly to FIGS. 1 and 2, there is shown an improved razor system designated generally 10 having a handle provided with a handgrip 12 and a pair of shanks 13 projecting from one end at a suitable angle to the handgrip such as 120°. Securely fixed to the outer end of each shank 13 is a channel shaped member 14 having outturned lips or flanges 15 along each of the sidewalls and lying in a common plane.

Figure 3:
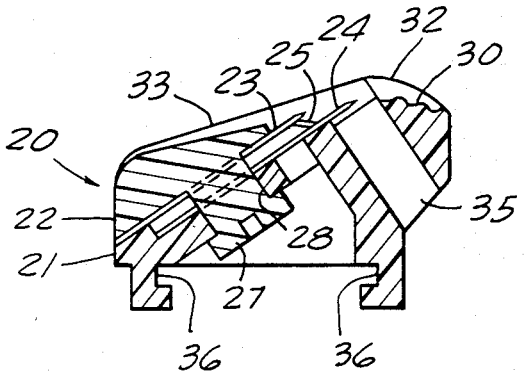
FIG. 3 is a cross sectional view through one of the razor heads showing structural details.

Telescopically assembled to each of channel members 14 is a razor head designated generally 20 and having structural features of the type disclosed in the patent to Dorion U.S. Pat. No. 3,724,070 incorporated herein by reference. Each head is a unitary assembly having a main body 21 and a cap 22. Sandwiched between the upper surface of a cavity in main body 21 and the underside of cap 22 are a pair of cutting blades 23, 24 and a separating spacer 25. These members are secured in an accurately predetermined position in a manner well known to persons skilled in this art and here represented by one or more assembly bosses 27 extending through an assembly opening 28 in main body 21. As is made clear by FIG. 3, the cutting edges of blades 23 and 24 are arranged in echelon and facing toward guard member 30 along the forward edge of the cutting head. The opposite ends of guard 30 and of cap 22 are provided with respective low height upstanding walls 32, 33 extending outwardly a short distance beyond the cutting edges of blades 23 and 24 to provide glide surfaces for the razor head as it is moved across the skin surface undergoing shaving. These protective glide surfaces supplement guard member 30 in safeguarding against cutting or damaging the user's skin.

Additional features of the razor head include an elongated passage 35 extending through the main body and underlying the cutting edges of the blades to provide an escape passage for cuttings. The underside of main body 21 is provided with an open ended T-shaped passage 36 extending from end to end of the main body and sized to have a snug sliding fit about the outturned lips of channel members 14. If desired, either passage 36 or the channel members may be provided with spring detent means of any suitable construction useful in holding head 20 releasably and firmly assembled to the channel members 14.

The described dual head razor system is used by preparing the surface to be shaved with lather or shaving cream in the usual manner. The razor system is then placed in contact with the prepared surface and moved forwardly and rearwardly. When being moved to the right as viewed in FIG. 2, the righthand head 20 is effective to remove the exposed ends of the beard whereas, if the razor system is moved upwardly and to the left, the set of blades in the lefthand head is effective to perform the cutting operation. A shaving operation is therefore carried out most expeditiously and efficiently in a minimum of time and with minimum effort. It will be understood that the two heads are identical and mountable interchangeably upon either of the channel members 14.

While the particular dual headed razor system herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A razor system for use in shaving in both to and fro strokes without removal from the surface being shaved comprising:

an elongated handle having a pair of spaced apart parallel channel shaped members having the mid-length thereof fixedly and immovably secured to and facing away from one end thereof each having out turned lips along the upper edges of their respective sidewalls and lying in a common plane inclined acutely to the longitudinal axis of said handle;

a pair of detachable razor heads telescopically assembled to a respective one of said channel shaped members;

said heads each having a blade clamped therein and lying in planes flaring outwardly in opposite directions and away from the common plane through the lips of said channel shaped members at substantially the same acute angle;

the adjacent lateral edges of said blades lying parallel to one another and being unsharpened and the other lateral edges being parallel and sharpened and remote from one another; and said heads each having a low height end wall along each end having the outer edge thereof lying in a plane spaced closely outwardly of the sharpened edges of a respective one of said blades.

2. A razor system as defined in claim 1 characterized in that each of said razor heads is provided with a pair of closely spaced apart parallel blades with the sharpened edges of each pair arranged in echelon and substantially similarly spaced inwardly from the plane of the rim edges of the associated pair of said razor head end walls.

3. A razor system as defined in claim 1 characterized in that said razor heads are selectively assemblable on either of said channel shaped members.

4. A razor system as defined in claim 1 characterized in that said razor heads are identical.

5. A razor system as defined in claim 2 characterized in that said razor heads are identical.

* * * * *